US005205411A

United States Patent [19]

Born et al.

[11] Patent Number: 5,205,411

[45] Date of Patent: Apr. 27, 1993

[54] END WALL FOR A WOUND ROLL, EXHIBITING IMPROVED RESISTANCE TO LATERAL BREAKING

[75] Inventors: Norbert Born, Blieskastel; Wolfgang Oberhausen, Mainz-Ebersheim, both of Fed. Rep. of Germany

[73] Assignee: Hoechst Aktiengesellschaft, Frankfurt am Main, Fed. Rep. of Germany

[21] Appl. No.: 910,441

[22] Filed: Jul. 8, 1992

[30] Foreign Application Priority Data

Jul. 8, 1991 [DE] Fed. Rep. of Germany ..... 9108405

[51] Int. Cl.[5] ..... B65D 21/02; B65D 85/66; B65D 85/672

[52] U.S. Cl. ..... 206/391; 206/397; 206/413; 206/416

[58] Field of Search ..... 206/391, 397, 403, 406, 206/408, 413, 414, 415, 416, 504, 509, 511

[56] References Cited

U.S. PATENT DOCUMENTS

| | | | |
|---|---|---|---|
| 2,849,151 | 8/1958 | Heil . | |
| 3,616,943 | 11/1971 | Brink . | |
| 4,058,216 | 11/1977 | Tsuyuguchi | 206/416 X |
| 4,253,570 | 3/1981 | O'Connor et al. | 206/391 |
| 4,732,271 | 3/1988 | Solyntjes | 206/416 X |
| 4,877,133 | 10/1989 | Klenter et al. | 206/416 |
| 4,884,690 | 12/1989 | Klenter et al. | 206/416 |
| 5,097,951 | 3/1992 | Pigott et al. | 206/397 X |

FOREIGN PATENT DOCUMENTS

| | | |
|---|---|---|
| 0217254 | 4/1987 | European Pat. Off. . |
| 0332186 | 9/1989 | European Pat. Off. . |
| 0447737A1 | 9/1991 | European Pat. Off. . |
| 8520270.3 | 7/1985 | Fed. Rep. of Germany . |
| 1266547 | 3/1928 | United Kingdom . |

*Primary Examiner*—Jimmy G. Foster
*Assistant Examiner*—Jacob K. Ackun, Jr.
*Attorney, Agent, or Firm*—Foley & Lardner

[57] ABSTRACT

An end wall for a wound roll, made from a moldable material and including a rectangular plate having rounded-off corners and a front side that faces in the direction of the wound roll, the front side having a smooth, flat surface; the rectangular plate further including a backside that faces outwardly away from the wound roll; radial webs and annular webs formed on the backside for reinforcing the rectangular plate; locking bosses formed on the front side of the rectangular plate; a central insertion peg for insertion in the wound roll located on the front side of the rectangular plate, stacking bosses and stacking pockets provided on at least two side walls of the rectangular plate, the stacking bosses being delimited by the stacking pockets of complementary design relative to the stacking bosses; and at least one side wall of the rectangular plate having a plane surface, wherein when wound rolls with the end walls attached are stacked side-by-side or vertically, the stacking bosses and stacking pockets of each end wall fit snugly into the stacking pockets and stacking bosses of mutually adjoining end walls.

8 Claims, 4 Drawing Sheets

END WALL FOR A WOUND ROLL, EXHIBITING IMPROVED RESISTANCE TO LATERAL BREAKING

BACKGROUND OF THE INVENTION

The present invention relates to an end wall for a wound roll, which is made from a moldable material and comprises a rectangular, in particular square, plate with rounded-off corners, the front surface of said plate, facing in the direction of the wound roll, having a smooth, plane surface, and the backside of said plate, facing outwardly, away from the wound roll, being stiffened by radial and annular webs, and a central insertion peg and locking bosses being provided on the front surface of said plate.

End walls of the above type, which are made of plastic or some other moldable material and which are used for packaging materials wound onto winding cores, for example plastic films, are known from EP-A-0,332,186. Two of these end walls, which are pushed onto the two end surfaces of the winding core, in each case form a rigid overall package for a wound roll.

Such end walls are also known from U.S. Pat. No. 4,884,690, assigned to the assignee of the present invention, which patent is hereby incorporated by reference in this application.

In the course of the practical use of known end walls of the above type, particularly during the transport of relatively big and heavy units on wooden pallets, the mechanical stability of the materials employed for the end wall has quite frequently proved to be insufficient, especially in the region of lateral stacking bosses. The excessive mechanical strain leads to damage of the end walls in the region of said lateral stacking bosses, such that the end walls are rendered unusable, and in some cases even the packaged rolls are damaged, which is absolutely unacceptable.

SUMMARY OF THE INVENTION

It is therefore an object of the present invention to improve end walls of the type described above such that, in addition to the mutual locking of the end walls of a plurality of wound rolls being stacked one above another and/or next to one another and being terminated by said end walls, any damage due to mechanical strain arising during transport of the wound rolls on pallets is avoided.

The present invention is an end wall for a wound roll, made from a moldable material and comprising a rectangular plate having rounded-off corners and a front side that faces in the direction of the wound roll, the front side having a smooth, flat surface, the rectangular plate further including a backside that faces outwardly away from the wound roll; radial webs and annular webs formed on the backside for reinforcing the rectangular plate; locking bosses formed on the front side of the rectangular plate; a central insertion peg for insertion in the wound roll located on the front side of the rectangular plate; stacking bosses and stacking pockets provided on at least two side walls of the rectangular plate, the stacking bosses being delimited by the stacking pockets of complementary design relative to the stacking bosses; and at least one side wall of the rectangular plate having a plane surface; wherein when wound rolls with the end walls attached are stacked side-by-side or vertically, the stacking bosses and stacking pockets of each end wall fit snugly into the stacking pockets and stacking bosses of mutually adjoining end walls.

The end wall of the invention further includes projections that are disposed on the at least one side wall having a plane surface, wherein the wound roll provided with the end walls is prevented from slipping on the boards of a transport pallet.

In accordance with the invention the stacking bosses have bevelled side surfaces which are inclined towards the center line of the side wall and pairs of stacking bosses lie flush with an upper edge and with a lower edge of a side wall.

BRIEF DESCRIPTION OF THE DRAWINGS

Below, the invention will be explained in even greater detail by reference to an embodiment illustrated in the attached figures, of which

DETAILED DESCRIPTION OF THE PREFERRED EMBODIMENTS

In accordance with the present invention, stacking bosses are provided on at least two of the four side walls of the plate, which stacking bosses delimit stacking pockets of complementary design relative to the stacking bosses, such that during the horizontal side-by-side stacking or during the vertical stacking of end walls aligned at right angles relative to one another, the stacking bosses and stacking pockets one one plate can be interconnected with the stacking pockets and stacking bosses of the side wall of a further end wall, and at least one side wall of he plate is constituted by a flat surface.

Preferably, stacking bosses and stocking pockets are provided on at least two sides of the plate, lying opposite to one another, and in particular, stacking bosses and pockets are provided on three sides of the plate.

In a further embodiment of the invention, projections are provided in the area of the flat surface, by which slipping of film rolls packed with the aid of the end walls according to this invention, on the boards of a transport pallet, is avoided. Preferably, these projections are designed as bodies having a geometrical shape narrowing towards the top end, i.e., in the direction leading away from said flat surface of the end wall, such as cones or appropriate webs, which may be arranged in parallel alignment or at inclined angles relative to one another or may be even have a cross-wise configuration and extend continuously or with interruptions across the level of said side wall.

In one embodiment of the invention, the stacking bosses have bevelled side faces, which are inclined in the direction of the center line of the respective side wall. In pairs, the stacking bosses are flush with the upper edge and the lower edge of a side wall.

The advantage achieved by means of the present invention resides in the fact that the stacking bosses and stacking pockets of the end walls are mutually engaged in a manner such that displacement of the wound rolls, stacked on top of one another or side-by-side, in the longitudinal or transverse direction is no longer possible. Due to the bevelled side faces of the stacking pockets and stacking bosses, problemless stacking and unstacking of the wound rolls packaged using the end walls of this invention is possible.

The end wall of this invention furthermore presents the advantage that the pressure arising is distributed more uniformly due to the flat design of that side of the end wall which during proper use of said end wall faces in the direction of the transport pallet, such that damaging of the end wall or even of the packaged goods is no longer possible.

Figure 1:
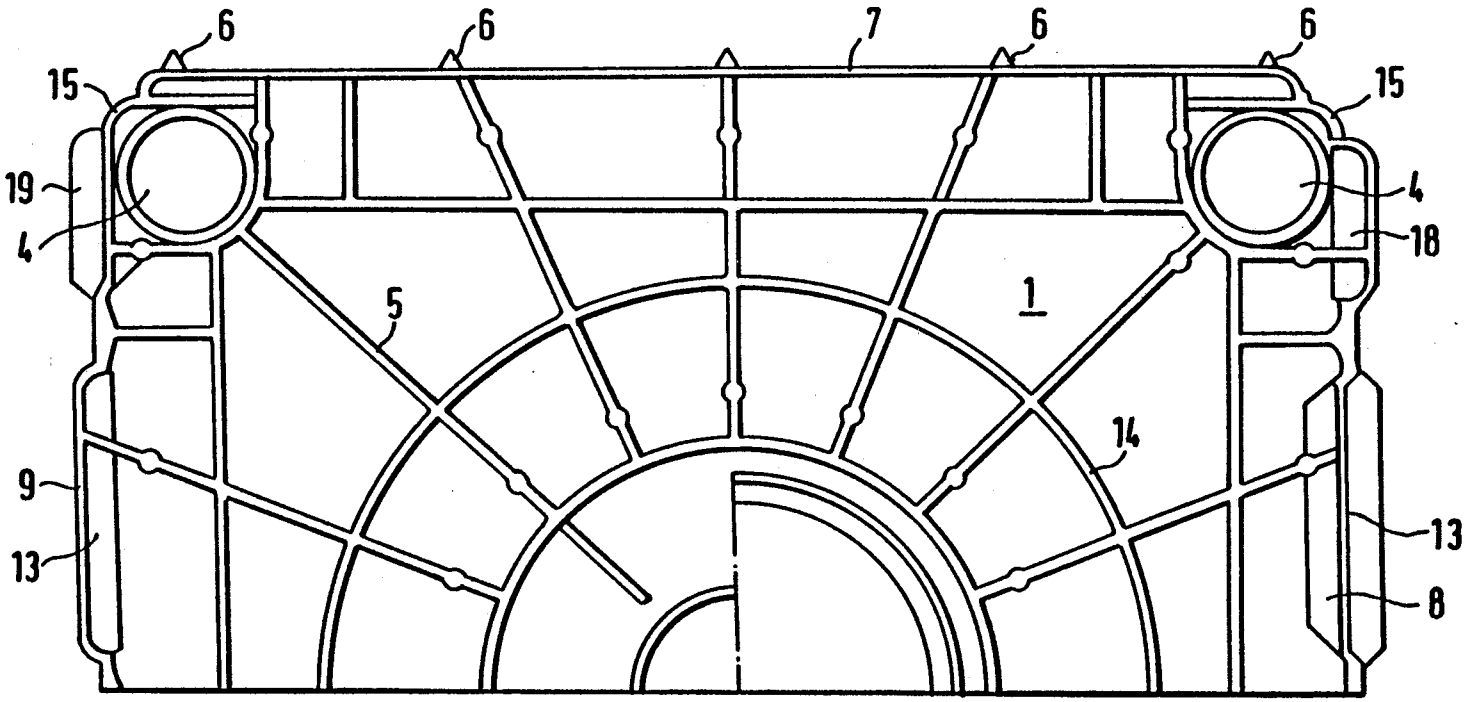
FIG. 1 shows a diagrammatical partial top view of the backside of an end wall according to this invention.

As can be seen from the diagrammatic representation of FIG. 1, the corner surfaces 15 of the end wall 1 are rounded-off, and the cylindrical locking bosses 4 are set off from or integrated with these corner surfaces (FIG. 3), and have the same radii as the rounded-off corner surfaces 15.

Cylindrical boss necks 16 are set-off from the locking bosses 4 by a shoulder (FIGS. 2 and 3) and have a smaller diameter than the locking bosses 4. The back side of the end wall 1 is provided with recesses 17 which are enclosed by rounded corner surfaces 15 and rounded webs. The hollow-cylindrical locking bosses 4 are directly above the recesses 17. If two horizontally aligned end walls 1 are stacked one above the other, the boss necks 16 of the locking bosses 4 of one end wall engage in the recesses 17 on the back side of the end wall lying there above. The insertion peg 2 likewise engages in the through-opening 12 thereby producing the possibility of stacking and palletizing the end walls in a space-saving manner. On the rear side of the end wall 1, which faces outwardly, away from the wound roll, radial webs 5 and annular webs 14 are shown, which stiffen the rear side, avoiding large wall thicknesses, so that the weight of the end wall 1 can be kept low. Due to these radial and annular webs, the end wall 1 has a high load-bearing capacity while having a low overall weight. On two of the sides 13 of the end wall, stacking bosses 9, 19 and stacking pockets 8, 18 are provided, the latter being of complementary design relative to the stacking bosses. The side 40 shown in FIG. 2 is designed as a flat surface which exhibits projections 6 shown as webs in the drawing.

Figure 2:
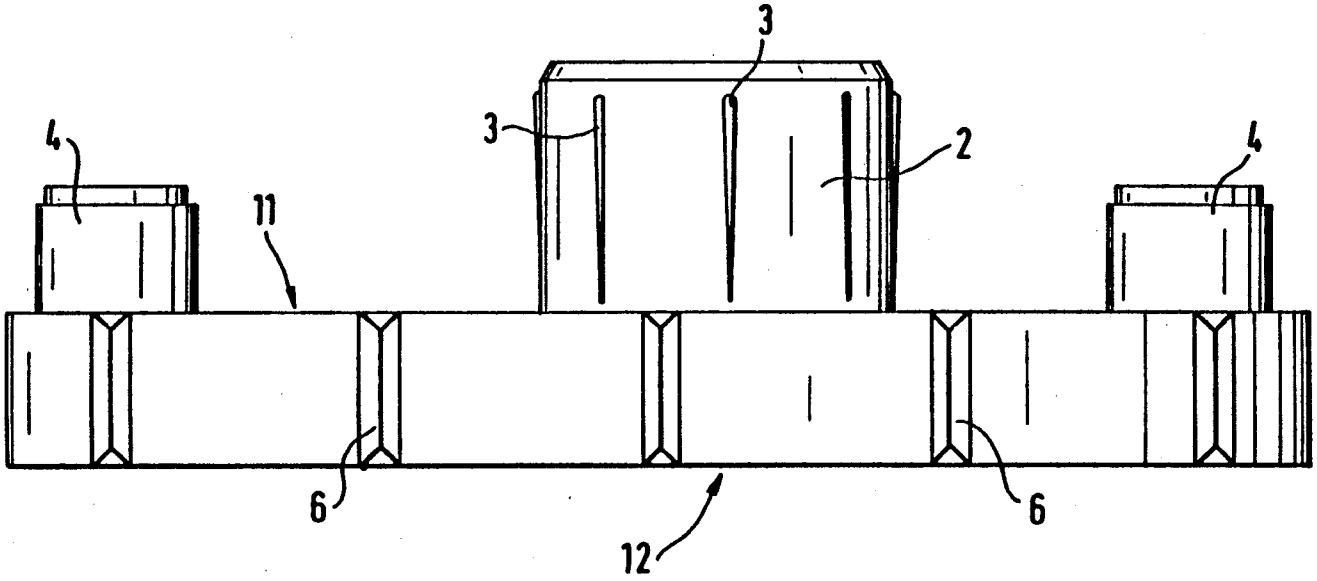
FIG. 2 shows a side view of an end wall according to this invention, which is designed as a flat surface.
Figure 3:
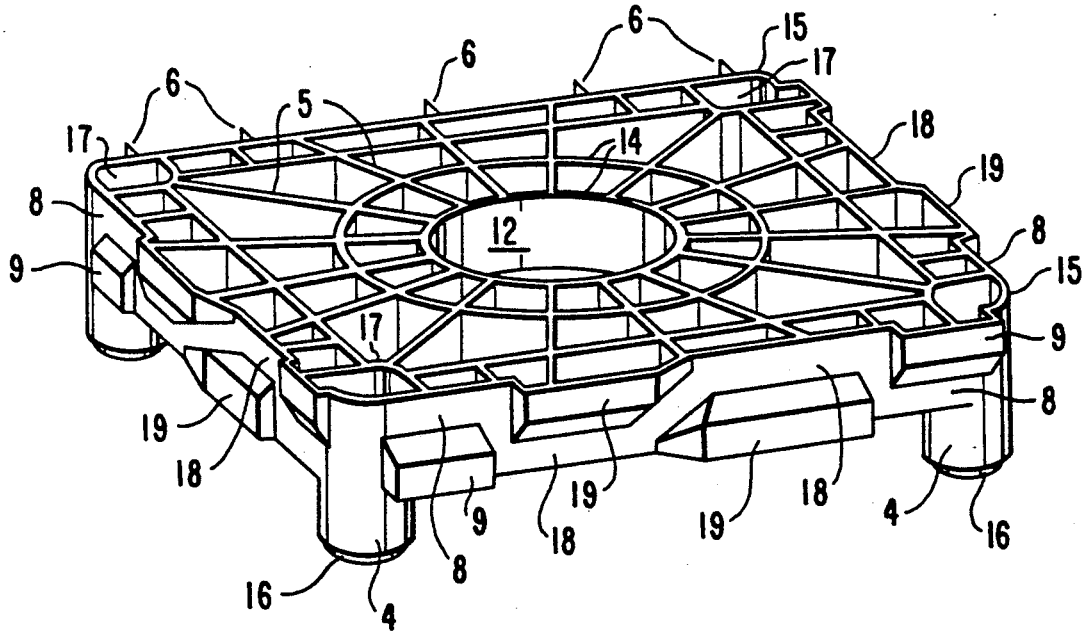
FIG. 3 shows a perspective view of an end wall of the invention.
Figure 4:
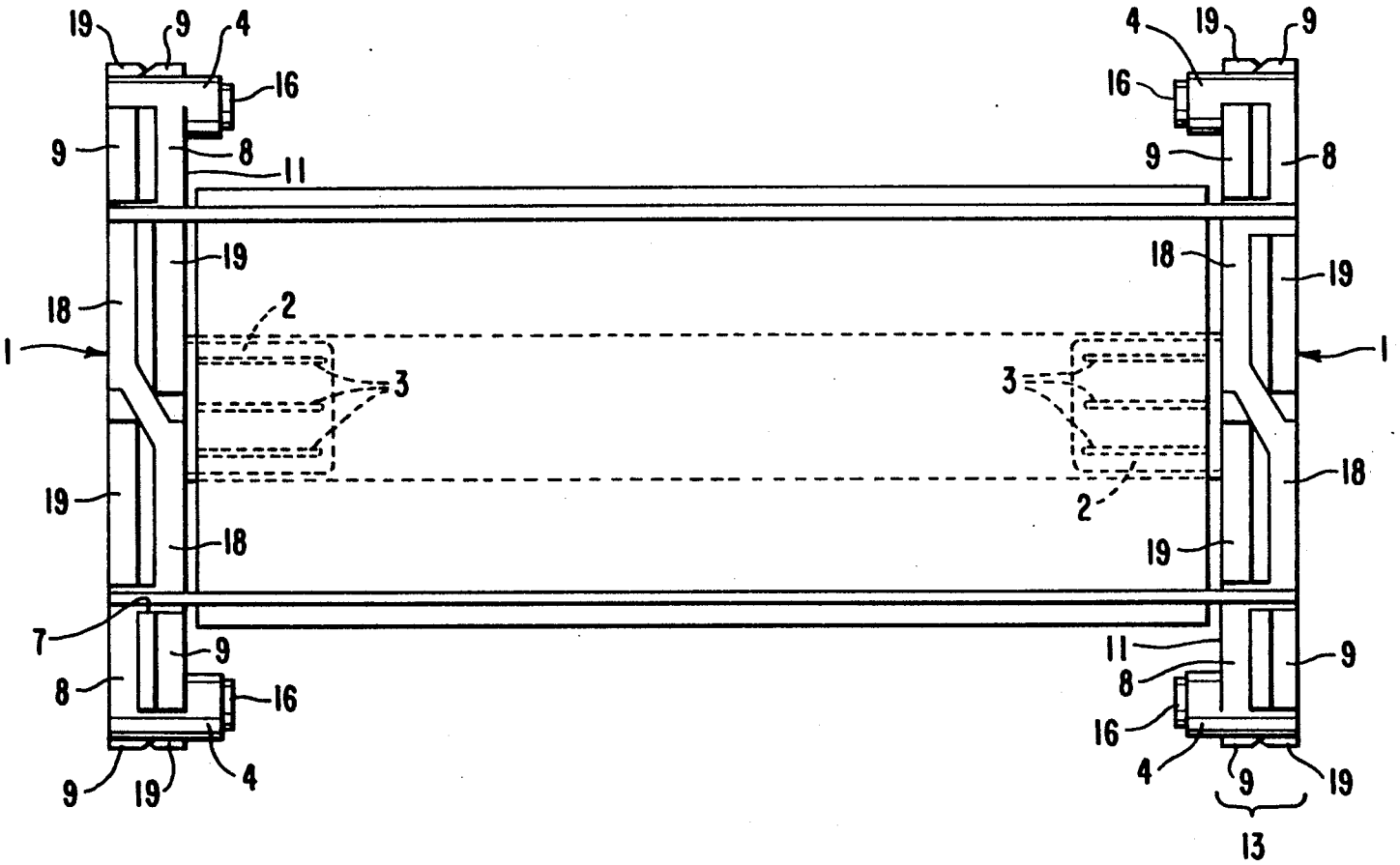
FIG. 4 shows a side view of the two end walls in place on a wound roll.

As can be seen from FIG. 3, the plate has a central cylindrical through-opening 12. The hollow cylindrical insertion peg 2 is connected to this central through-opening 12. The diameter of the through-opening 12 is greater than the outer diameter of the insertion peg 2. V-shaped webs 3 are provided on the outer surface of the insertion peg 2 (FIG. 2), which extend parallel to the longitudinal axis of said insertion peg and whose cross-section narrows in the direction of the front side of the plate 11, The insertion peg 2 is pressed into the central opening of the winding core, as shown in FIG. 4. The V-shaped webs 3 on the insertion peg 2 guarantee a tighter fitting of the peg to the winding core and compensate for small dimensional variations of the winding core and of the insertion peg.

In FIG. 2, the web shape of the projections 6 is outlined quite clearly.

Many changes and modifications within the scope of the present invention may be made without departing from the spirit thereof, and the invention includes all such modifications.

What is claimed is:

1. An end wall for a wound roll, said end wall being made from a moldable material and comprising:

a rectangular plate having a plurality of sidewalls, rounded-off corners, and a front side facing in the direction of the wound roll, the front side having a smooth, flat surface; the rectangular plate further including a backside facing outwardly away from the wound roll;

radial webs and annular webs formed on the backside for reinforcing the rectangular plate;

locking bosses formed on the front side of the rectangular plate;

a central insertion peg for insertion in the wound roll located on the front side of the rectangular plate; and stacking bosses and stacking pockets provided on at least two of said side walls of the rectangular plate, the stacking bosses being delimited by the stacking pockets of complementary design relative to the stacking bosses;

wherein at least one of said side walls has a plane surface;

wherein when wound rolls with end walls attached thereto are stacked side-by-side or vertically, the stacking bosses and stacking pockets of each end wall fit snugly into the stacking pockets and stacking bosses, respectively, of mutually adjoining end walls.

2. The end wall as claimed in claim 1, wherein the at least two side walls of the rectangular plate provided with stacking bosses are opposite side walls.

3. The end wall as claimed in claim 1, wherein stacking bosses and stacking pockets are provided on three side walls of the rectangular plate.

4. The end wall as claimed in claim 1, wherein projections are disposed on the at least one side wall having a plane surface, wherein the wound roll provided with the end walls is prevented from slipping on the boards of a transport pallet.

5. The end wall as claimed in claim 4, wherein the projections have the shape of geometrical figures narrowing towards a top end.

6. The end wall as claimed in claim 4, wherein the projections have the shape of webs which are arranged parallel to one another.

7. The end wall as claimed in claim 1, wherein the stacking bosses have bevelled side faces which are inclined towards the center line of the side wall and pairs of stacking bosses lie flush with an upper edge and with a lower edge of one of said side walls.

8. The end wall of claim 1, wherein the rectangular plate is a square plate.

* * * * *